United States Patent [19]

Manhardt et al.

[11] Patent Number: 4,917,308

[45] Date of Patent: Apr. 17, 1990

[54] FLOW RATE LIMITING DEVICE FOR FUEL DISPENSING NOZZLES

[76] Inventors: Paul D. Manhardt, 1008 Tokalon Dr., Knoxville, Tenn. 37922; Leonard R. Nitzberg, P.O. Drawer 107, Knoxville, Tenn. 37919

[21] Appl. No.: 349,057

[22] Filed: May 9, 1989

Related U.S. Application Data

[63] Continuation-in-part of Ser. No. 165,756, Mar. 9, 1988, Pat. No. 4,844,344.

[51] Int. Cl.[4] ..... B05B 1/30; B67D 5/377

[52] U.S. Cl. ..... 239/590; 239/590.3; 239/590.5; 222/547; 222/564; 138/40

[58] Field of Search ..... 239/461, 463, 466, 482, 239/483, 589, 590, 590.3, 590.5, 592, 594; 222/544, 547, 564; 141/206-208; 138/40-46; 406/83, 86, 92, 191, 195

[56] References Cited

U.S. PATENT DOCUMENTS

| | | | |
|---|---|---|---|
| 1,125,642 | 1/1915 | Blanchard | 239/461 |
| 1,176,935 | 3/1916 | Walden et al. | 239/590 |
| 2,054,964 | 9/1936 | Barker | 239/461 |
| 2,478,998 | 8/1949 | Boyd et al. | 138/40 |
| 2,562,930 | 8/1951 | Mapes | 239/590 |
| 2,602,701 | 7/1952 | Walter | 239/461 |
| 3,154,132 | 10/1964 | Mazzeo | 239/590 |
| 3,428,258 | 2/1969 | Duggan | 239/590.5 |
| 3,749,130 | 7/1973 | Howitt et al. | 138/42 |
| 3,964,875 | 6/1976 | Chang et al. | 138/42 |
| 4,213,488 | 7/1980 | Pyle | 141/207 |

*Primary Examiner*—Andres Kashnikow
*Assistant Examiner*—Karen B. Merritt
*Attorney, Agent, or Firm*—Alan Ruderman

[57] ABSTRACT

A fuel dispensing nozzle for gasoline fuel pumping stations and the like has an inlet through which the fuel is supplied within a range of supply inlet pressures, an outlet from which fuel is discharged and a flow passage having valving for selectively opening communication between the inlet and the outlet. At least one turbulence generating body is located in the flow passage between the inlet and the outlet and a turbulence damping or laminar flow inducing member is disposed in the flow passage upstream from the turbulence generating body member. The turbulence damping body member ensures that substantially laminar flow is directed to the turbulence generating member which thereby may predictably limit the rate of fuel flow through the nozzle to a predetermined maximum rate independent of the fuel inlet pressure within the supply range and independent of the amount of communication provided between the inlet and the outlet by the valving.

8 Claims, 2 Drawing Sheets

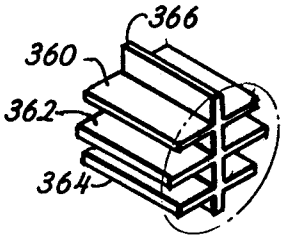
FIG. 3
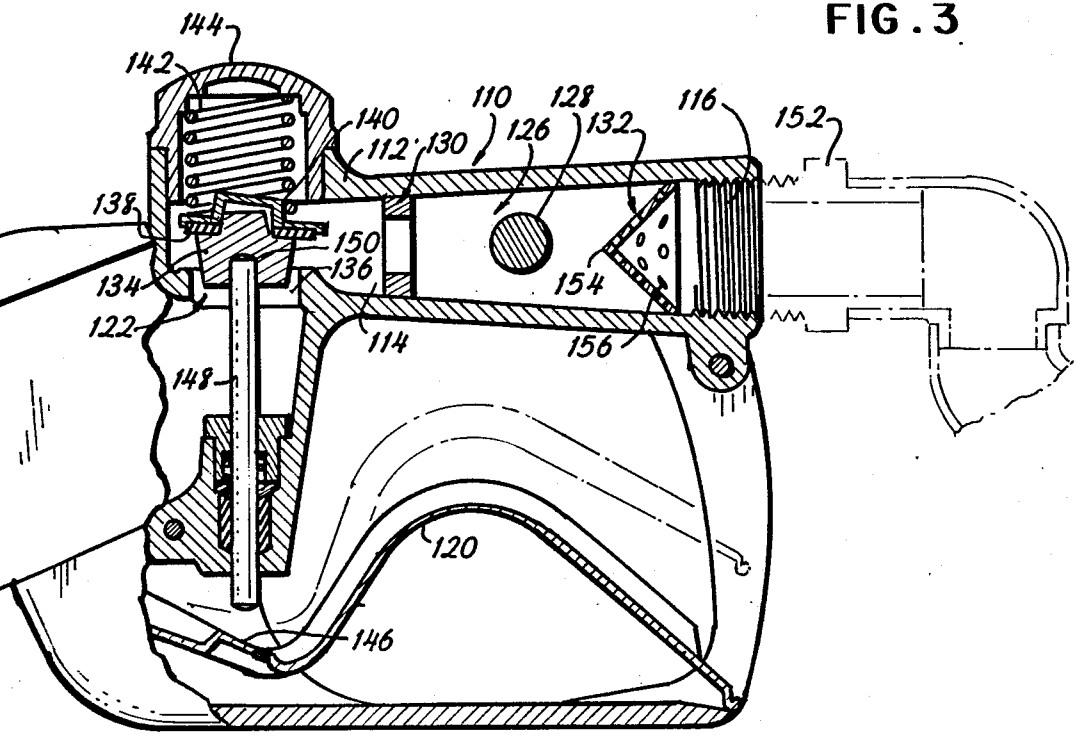
FIG. 2
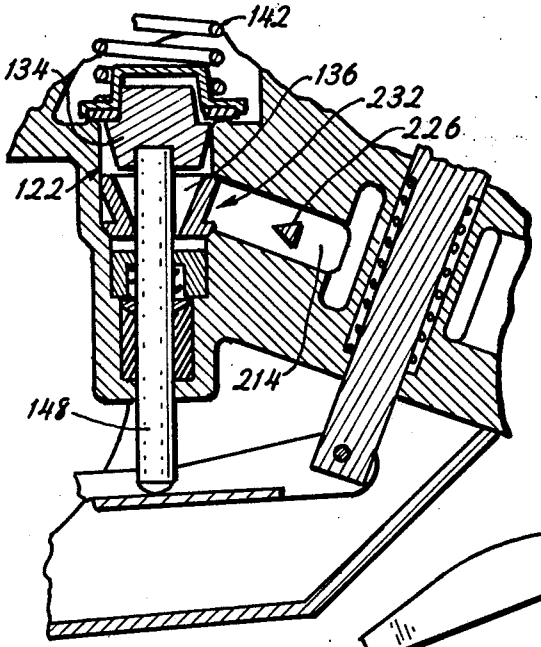
FIG. 4
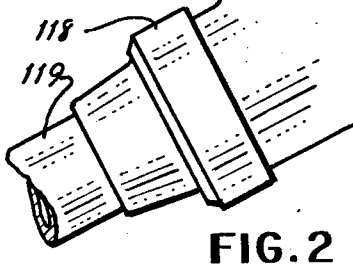

FLOW RATE LIMITING DEVICE FOR FUEL DISPENSING NOZZLES

REFERENCE TO RELATED APPLICATIONS

This application is a continuation-in-part of copending U.S. patent application Ser. No. 07/165,756, filed Mar. 9, 1988, now U.S. Pat. No. 4,844,344.

BACKGROUND OF THE INVENTION

This invention relates to fuel dispensing nozzles, and more particularly to apparatus for limiting the rate of flow of fuel through a fuel dispensing nozzle such that it is prevented from exceeding a preselected maximum flow rate.

Fuel dispensing nozzles are commonly used to dispense gasoline or other fuels into fuel tanks of motorized vehicles. Conventional dispensing nozzles include a nozzle body defining an internal flow passage extending between the nozzle inlet and its outlet. The inlet of the nozzle is connected to a supply hose which feeds pressurized gasoline or other fuel to the nozzle. This pressurized fuel passes through the internal flow passage to an outlet which consists of, or is connected to, a spout which serves as the discharge end of the nozzle. The spout is inserted into the neck of a motorized vehicle's fuel tank during filling operations. The pressurized fuel flow through the internal fuel passage is conventionally controlled by a valve which is actuated by a manually operated valve lever selectively depressed by the nozzle user during dispensing operations.

Fuel, under pressure created by a pump, is fed through the nozzle at flow rates established by the pump capacity and the extent to which the valve lever is actuated. It has been found that the rapid flow rates capable of being generated by conventional fuel pumps feeding the nozzle produce gasoline or other fuel fumes which escape into the atmosphere. Due to the wide spread use of dispensing nozzles and the volume of fumes escaping during dispensing operations, government regulations have been proposed which are designed to limit the rate of flow of fuel through the dispensing nozzle. By limiting the rate of flow, the amount of fumes escaping can be reduced to a level which is less likely to cause significant damage to the earth's atmosphere.

In our aforesaid copending patent application a fuel dispensing nozzle such as those at gasoline service stations and the like proposed a flow restriction device within the body of the nozzle, the device creating turbulence which provides a resistance to flow so that the delivery rate could not exceed a predetermined maximum despite variations within a range of supply inlet pressures. Inherent in that apparatus is a predictability of flow pattern at the point of use of the device in order to provide a margin of accuracy in the determination of the predicted maximum rate in the prevailing environment of use including extreme variations in delivery pressure, specific maximum rates imposed by regulatory agencies, and the necessity to approximate those maximum rates in order to provide maximum utilization of the petroleum industries distribution equipment. For example, one of the problems in limiting the fuel flow through a fuel nozzle is that the fuel inlet pressure varies considerably at the various dispensing stations, e.g., the fuel inlet pressure may vary between approximately 8 psi and above 55 psi. If a small diameter nozzle outlet were utilized, and if a 10 gallons per minute level were to be established at 55 psi, then at an 8 psi station the flow through the nozzle would be too low from a practical standpoint. If the 10 gallons per minute limitation were established at 8 psi, then the flow rate would be excessive at a station pumping at 55 psi.

Accordingly, the apparatus of the aforesaid patent application placed a turbulence creating member within the nozzle between the inlet and the valve so as to restrict and limit the fuel flow to a predetermined maximum rate irrespective of the inlet pressure within the 8 psi to 55 psi range and irrespective of the amount that the valve is opened. It was found that as the fuel passage within the nozzle is blocked, a turbulent flow occurred which hindered the flow of the fuel through the nozzle, and as the inlet pressure increased within the range, the turbulence increased in a non-linear fashion resulting in a type of feedback which further retarded the flow and maintained the flow at a maximum level. Thus, the flow control mechanism maintained the flow constant within the range of inlet pressures. In order to obtain predictable results the turbulence generating means in our aforesaid copending patent application had to be disposed upstream of the valve so that it received the fuel in a substantially laminar flow condition. The laminar flow upstream of the turbulence generating means results from several feet of hose attached to the inlet to the nozzle. The valve itself creates a turbulence to the flow of fuel and if the valve were disposed upstream of the turbulence generating means, unpredictable fuel rates would result. The reason for this is that present valve designs provide a valve chamber at some angle to the flow passage through the nozzle. The valve comprises a spring urged "bonnet" valving means mounted on a long push-rod type valve stem and includes a skirt portion which both guides the bonnet when it is urged closed and also tends to restrict flow past the bonnet thereby providing more sensitive control to the operator. In many instances the valve bonnet is adapted to angularly disorientate or tilt during the initial opening or just prior to closing to provide a "penny-pincher" mode such as described in U.S. Pat. No. 3,330,479. The direction of slant or tilt of the valve bonnet in this mode is random. Further, the amount and direction of eccentricity of the skirt of the bonnet within the valve chamber is a function of the pressure against the bonnet, the loading on the spring, and the amount of wear on the valve stem packing. The flow path of liquid downstream of the manually operated valve, at any specific flow rate, is therefore random and unpredictable. Thus, the turbulence generating means was disposed intermediate the inlet and the valve.

However, many fuel service or filling stations presently utilize swivel mechanisms such as that disclosed in U.S. Pat. Nos. 2,745,682 and 3,558,163 and additionally swivel/breakaway mechanisms such as that disclosed in U.S Pat. No. 4,791,961, such mechanisms being being proximate the entry to the nozzle and between the hose and the nozzle. These devices vary in design and flow characteristics, not only from device to device, but also from one specific flexure position to another, within the same device. Accordingly, the flow of fuel into the inlet of the nozzle may not be laminar, but would have turbulent characteristics, in which case the desired predictability and control of fuel flow rate may not be attained.

SUMMARY OF THE INVENTION

Consequently, it is a primary object of the present invention to provide a liquid fuel dispensing nozzle having fuel flow rate limiting apparatus within the body of the nozzle, the flow rate limiting apparatus having turbulence generating means disposed downstream from turbulence damping or laminar flow inducing means which substantially reduces or eliminates turbulence in the fuel to provide substantially laminar flow which is directed to the turbulence generating means so that the turbulence generating means may predictably limit the flow rate to a predetermined maximum.

It is another object of the present invention to provide a liquid fuel dispensing nozzle having fuel flow limiting apparatus within the body of the nozzle, the flow rate limiting apparatus having turbulence generating body means disposed downstream from a flow straightening device which predictably directs the fuel while substantially eliminating eddy currents so that the fuel flow in the vicinity of the entry to the turbulence generating means is substantially laminar, whereby the turbulence generating means may predictably limit the volumetric rate of fuel flow within the range of fuel inlet pressures encountered by the nozzle.

It is a further object of the present invention to provide a liquid fuel dispensing nozzle having fuel flow rate limiting apparatus within the body of the nozzle, the flow rate limiting apparatus having turbulence generating body means intermediate the inlet and the outlet of the nozzle and intermediate the outlet and a turbulence damping or laminar flow inducing means, the turbulence damping or laminar flow inducing means acting to limit the turbulence in the fuel to approximate laminar flow so that the fuel flows in substantially laminar fashion to the turbulence generating body means which thereby predictably limits the fuel flow to a predetermined maximum independent of the nozzle supply pressure and independent of the communication provided between the nozzle inlet and outlet by valving within the nozzle.

Accordingly, the present invention provides a fuel dispensing nozzle for dispensing gasoline at fuel pumping stations and the like, the nozzle having an inlet through which the fuel is supplied within the range of supply inlet pressures encountered at such stations, and an outlet from which the fuel is discharged. The nozzle includes a flow passage having manually operable valving for selectively opening communication between the inlet and the outlet. At least one turbulence generating body member is disposed in the flow passage between the inlet and the outlet either upstream or downstream of the valving, but downstream from turbulence damping or laminar flow inducing means which is also disposed within the flow passage so that the fuel flowing to the turbulence generating member is substantially laminar and may predictably limit the rate of fuel flowing through the nozzle to a predetermined maximum rate independent of the fuel inlet pressure within the supply pressure range and independent of the amount of communication provided between the inlet and outlet by the valving.

In the preferred form of the invention the turbulence damping or laminar flow inducing means may be a flow straightening device such as a screen member or a series of straightening baffles, or a cast porous media which reduces or substantially eliminates eddy currents and provides substantially laminar flow within the required range of pressures and flow rates in the flow passage proximate the turbulence generating member.

By placement of the turbulence generating member intermediate the turbulence damping or laminar flow inducing means and the outlet of the nozzle, the turbulence generating means may be designed to predictably maintain the flow rate at a predetermined level, e.g., 10 gallons per minute independent of the fuel inlet pressure within the usual range encountered in the field and independent of the amount that the manually operable valve is opened. Thus, the apparatus may limit the flow rate to that required by regulations whether or not there is a turbulence creating swivel mechanism connected to the inlet of the nozzle and, as long as the turbulence damping or laminar flow inducing means is upstream of the turbulence generating member, independent of the location of the valving. The terms turbulence damping means and laminar flow inducing means may be used interchangably in this application and are defined as such means which reduces the amount of eddy currents and thus the turbulence of the fuel so that the fuel flowing as a result thereof is substantially laminar or sufficiently approximate to laminar so that the flow is suitable for positioning the turbulence generating body means therein to obtain predictable control of the maximum fuel rate to a desired predetermined amount.

DESCRIPTION OF THE DRAWINGS

The particular features and advantages of the invention as well as other objects will become apparent from the following description taken in connection with the accompanying drawings, in which:

FIG. 2 is a fragmentary elevational view partly in cross section of a fuel dispensing nozzle including apparatus constructed in accordance with one embodiment of the invention, the apparatus being disposed upstream of the valving;

FIG. 3 is a perspective view of an alternative form of a turbulence damping or laminar flow inducing member which may be utilized in the nozzle illustrated in FIG. 2; and FIG. 4 is a fragmentary elevational view partly in cross section of a fuel dispensing nozzle including apparatus constructed in accordance with another embodiment of the present invention, the apparatus being here disposed downstream of the valving.

DESCRIPTION OF THE PREFERRED EMBODIMENTS

Figure 1:
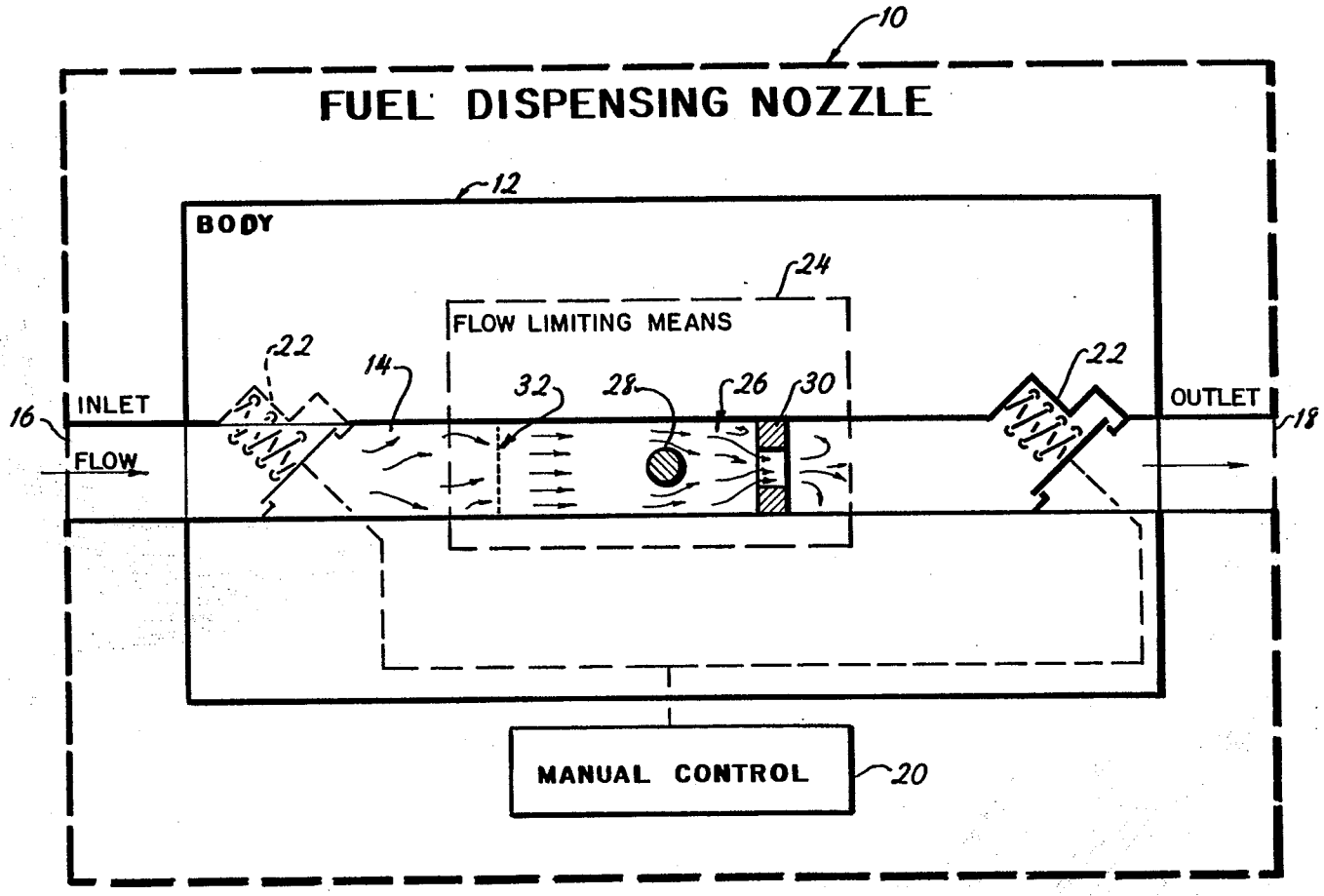
FIG. 1 is a schematic representation illustrating a fuel dispensing nozzle including apparatus constructed in accordance with the principles of the present invention and depicting manually operable valving in alternate positions.

Referring now to the drawings, FIG. 1 illustrates schematically a broad overview of the present invention. A fuel dispensing nozzle 10 includes a body 12 having a flow passage 14 communicating an inlet 16 with an outlet 18. A manually operable trigger 20 controls conventional valving 22 within the passage 14, the valving being illustrated in alternate positions relative to fuel flow limiting means 24 of the present invention. Thus, the valving 22 is illustrated by solid lines downstream of the flow limiting means 24 and by broken lines upstream of the flow limiting means 24. In the former instance the valve is intermediate the flow limiting means 24 and the outlet 18, while in the latter instance it is intermediate the inlet 16 and the flow limiting means 24. In our aforesaid patent application the valving was always downstream of the flow limiting means, but the flow limiting means there merely comprised turbulence generating means 26 such as, for example, a spherical member 28 which may be aided, if necessary and desirable, by a constricting ring 30. In the present instance a turbulence damping or laminar flow inducing means 32 is disposed upstream of the turbulence generating means to ensure that the fluid entering the turbulence generating means 26 is in a sufficiently non-turbulent condition or in a sufficiently laminar flow condition so that predictable retardation of flow to a predetermined maximum may be provided by the turbulence generating means.

In FIG. 2 a first embodiment of a preferred form of the invention is disclosed in conjunction with a fuel dispensing nozzle 110 having a body portion 112 within which a flow passage 114 is formed, the passage receiving fuel from an inlet 116 under pressure supplied by pumping means (not illustrated) at the fuel dispensing station and directing it to an outlet 118 which conventionally comprises or may be connected to a discharge spout 119 for insertion into the neck of an automobile fuel receiving tank (not illustrated). A trigger lever 120 conventionally is pivotably connected for manual operation of valving 122. The valving 122 conventionally comprises a tapered valve member 134 receivable within a passageway in a valve chamber 136 formed in the passage 114 and normally urged to close the chamber and shut communication of the fuel from the inlet 116 to the outlet 118. An annular sealing ring 138 is positioned on the valve member 134 and an annular head 140 is disposed on and about the ring 138. A coil spring 142 acts between the head 140 and a cap 144 connected to the body 112 above the passageway for closing the valve chamber, the spring acting to urge the valve member 134 into closing relationship with the pasageway to shut flow communication between the inlet 116 and the outlet 118 until the trigger 120 is squeezed. The trigger 120 includes a detent 146 within which an actuating rod 148 is received, the rod extending into the fuel passage and being received within a recess 150 in the valve member 134. Thus, when the trigger 120 is squeezed the valve member 134 is forced out of closing relationship with the fuel passage against the urging of the spring 142, the passageway being opened in proportion to the movement of the trigger and, conventionally, the amount of fuel flowing being dependent upon the amount the passageway is opened.

In accordance with the teachings of our aforesaid copending application, the turbulence generating means 126 provided by the spherical body member 128 and, if desired, additionally by the constricting ring 130, acts to create a turbulent flow which hinders the flow through the nozzle and limits the rate of fuel flowing therethrough to a predetermined maximum rate which is independent of the fuel inlet pressure within the range of pressures normally expected at fuel pumping stations and also independent of the amount that the valve member 134 is moved once it has been moved sufficiently to provide the maximum rate. However, the flow of fuel to the turbulence generating means 126 must be substantially laminar in order to obtain predictable flow rates so that the maximum rate may be limited to a predetermined amount.

Accordingly, if the inlet 116 of the nozzle is connected to a turbulence creating device, such as a swivel device 152, which may be a conventional swivel mechanism or may be a combination swivel/breakaway, as illustrated in the aforesaid patents, then predictable results may be lost since these devices provide varying degrees of turbulence from device to device, and for the different positions of the device. Thus, even if the turbulence generating device is upstream from the turbulence creating valve 122, the swivel device may prevent proper operation of the flow rate limiting or turbulence generating means 126. To overcome this problem the present invention provides the turbulence damping means 132 upstream of the turbulence generating means 126 for reducing the eddy currents in the fuel and inducing flow which is at least substantially laminar in the portion of the passage 114 upstream of the turbulence generating means so that the turbulence generating means 126 may perform predictably.

In the embodiment of FIG. 2, the turbulence damping means comprises a porous sheet or strainer 132 which may be in the form of a conical screen configuration with the apex 154 extending in the direction of flow and with the base periphery fastened to the wall of the passage 114 adjacent the inlet 116. The damping cone 132 has a plurality of apertures 156 disposed throughout the surface thereof and extending therethrough so that eddy currents in the fuel flowing into the cone are substantially eliminated thereby resulting in substantially laminar flow in the range of inlet pressures encountered and the range of fuel flow rates near the predetermined maximum rate.

In FIG. 3 another damper 332 is illustrated for use as an alternative to the damper 132. Here there are a series of baffle plates or vanes 360, 362, 364 disposed with their respective faces substantially in the direction of fuel flow, the plates 360, 362, 364 being interconnected by at least one other baffle plate 366 substantially normal to the baffle plates 360, 362, 364 and having its surface extending in the direction of flow so that a series of flow straightening plates are formed. The edges of the plates parallel to the direction of flow being fastened to the wall of the flow passage.

In FIG. 4 an embodiment of the invention is illustrated with the turbulence generating flow limiting means 226 downstream of the valving 122, the turbulence damping means 232 being disposed intermediate the valving and the turbulence generating means so that again the damper is upstream of the flow rate limiter. Here, the turbulence generating flow rate limiter 226 may be in the form of a conical body member for constricting the flow in the fuel passage 214 and creating turbulence as described in our aforesaid copending patent application, and the damping means 232 may comprise a cast porous media having an annular configuration positioned in the passage about the rod 148 so that the fuel flowing through the valve chamber 136 past the valve member 134 must flow through the media prior to entering the passage where the conical turbulence generating body 226 is disposed. The porous media comprises particles of grit such as used in automobile fuel filters cast to the desired configuration, such as a cylinder or the conical configuration illustrated.

It should be understood that any of the various turbulence generating means disclosed and suggested in our earlier copending patent application may be utilized in the present invention along with any form of turbulence damping or laminar flow inducing means. The critical aspect of the present invention is that the turbulence damping or laminar flow inducing means be upstream of and proximate the turbulence generating fuel rate limiting means and downstream from any turbulence creating device imposed in or in conjunction with the nozzle, such as the valving or a swivel device.

Numerous alterations of the structure herein disclosed will suggest themselves to those skilled in the art. However, it is to be understood that the present disclosure relates to the preferred embodiment of the invention which is for purposes of illustration only and not to be construed as a limitation of the invention. All such modifications which do not depart from the spirit of the invention are intended to be included within the scope of the appended claims.

Having thus set forth the nature of the invention, what is claimed herein is:

1. A fuel dispensing nozzle having an inlet through which liquid fuel is supplied within a range of supply inlet pressures, an outlet from which liquid fuel is discharged, an internal flow passage through which fuel may flow from the inlet to the outlet, valve means disposed within said fuel passage intermediate said inlet and said outlet for selectively opening communication between said inlet and said outlet to permit fuel to flow from said inlet to said outlet, and a flow rate limiting means, said flow rate limiting means including turbulence damping means in the fuel passage for inducing substantially laminar flow within a portion of the fuel passage, and a turbulence generating body member disposed in said portion of said passage for limiting the volumetric rate of fuel flowing through said nozzle to a predetermined maximum rate independent of the fuel inlet pressure within said range and independent of the amount of communication provided between said inlet and said outlet by said valve means.

2. A fuel dispensing nozzle as recited in claim 1, wherein said flow rate limiting means is disposed intermediate said valve means and said outlet.

3. A fuel dispensing nozzle as recited in claim 1, including swivel means connected to said inlet, and said flow rate limiting means is disposed intermediate said inlet and said valve means.

4. A fuel dispensing nozzle as recited in claim 1, wherein said turbulence damping means comprises flow straightening means for reducing eddy currents in said fuel.

5. A fuel dispensing nozzle as recited in claim 4, wherein said flow straightening means comprises a perforated conical screen.

6. A fuel dispensing nozzle as recited in claim 4, wherein said flow straightening means comprises a plurality of baffle plates having surfaces aligned with the direction of flow.

7. A fuel dispensing nozzle as recited in claim 4, wherein said flow straightening means comprises an annular porous grit media disposed about a portion of said valve means.

8. A fuel dispensing nozzle having an inlet through which liquid fuel is supplied within a range of supply inlet pressures, an outlet from which liquid fuel is discharged, an internal flow passage through which fuel may flow from the inlet to the outlet, valve means disposed within said fuel passage intermediate said inlet and said outlet for selectively opening communication between said inlet and said outlet to permit fuel to flow from said inlet to said outlet, and flow rate limiting means, said flow rate limiting means including turbulence damping means in the fuel passage for reducing flow turbulence within a portion of the fuel passage downstream of said damping means, and a turbulence generating body member disposed in said portion of said passage for predictably limiting the volumetric rate of fuel flowing through said nozzle to a predetermined maximum rate independent of the fuel inlet pressure within said range and independent of the amount of communication provided between said inlet and said outlet by said valve means.

* * * * *